US007287990B1

(12) United States Patent
Collier et al.

(10) Patent No.: US 7,287,990 B1
(45) Date of Patent: Oct. 30, 2007

(54) METHOD AND APPARATUS FOR GROUNDING A CABLE

(75) Inventors: Christopher D. Collier, Victorville, CA (US); John S. Huffman, Conyers, GA (US); David Roberts, Coppell, TX (US)

(73) Assignee: AT&T Corp., New York, NY (US)

( * ) Notice: Subject to any disclaimer, the term of this patent is extended or adjusted under 35 U.S.C. 154(b) by 0 days.

(21) Appl. No.: 11/490,819

(22) Filed: Jul. 21, 2006

(51) Int. Cl.
*H01R 13/648* (2006.01)

(52) U.S. Cl. ..... 439/98

(58) Field of Classification Search ..... 439/98, 439/95, 607–610, 399, 401, 559, 142, 76.1, 439/76.2; 174/50, 92, 65, 66, 67, 91; 361/119, 361/120; 379/413, 399; 385/136
See application file for complete search history.

(56) References Cited

U.S. PATENT DOCUMENTS 3,666,134 A * 5/1972 Rauch ..... 220/324
4,723,919 A * 2/1988 Crane ..... 439/521
4,800,588 A * 1/1989 Poster, Jr. ..... 379/412
4,882,647 A * 11/1989 Collins ..... 361/119
4,910,770 A * 3/1990 Collins et al. ..... 379/413.02
5,489,039 A * 2/1996 Brownlie et al. ..... 220/832
5,600,716 A * 2/1997 Broome et al. ..... 379/413.04
5,708,751 A * 1/1998 Mattei ..... 385/135
5,914,846 A * 6/1999 Smith et al. ..... 361/119
5,964,920 A * 10/1999 Proler ..... 75/583
6,045,390 A * 4/2000 Metz et al. ..... 439/405
6,591,055 B1 * 7/2003 Eslambolchi et al. ..... 385/136
6,616,463 B1 * 9/2003 Burnett et al. ..... 439/98
6,727,429 B1 * 4/2004 Koessler ..... 174/50
6,795,552 B1 * 9/2004 Stanush et al. ..... 379/413.01
6,814,617 B2 * 11/2004 Oota et al. ..... 439/589

* cited by examiner

*Primary Examiner*—Alexander Gilman

(57) ABSTRACT

A method and apparatus for grounding cables (e.g., fiber cables or copper wire cables) used in networks such as the telecommunications networks are disclosed. For example, the apparatus comprises an enclosure having a plurality of metal posts, e.g., metallic bolts, (e.g. brass or copper) for connecting with cables and at least one grounding rod. The apparatus contains apertures for allowing cables and at least one grounding rod to be brought into the apparatus in order to reach the metal posts. The grounding rod is then connected to one of the posts, and one or more of the cables are also connected to one or more of the posts. In one embodiment, the apparatus employs a movable cover with a conducting member (e.g., a metal hinged plate) mounted onto the movable cover. In operation, the metal plate makes contact with all the posts and provides grounding to all the cables when the cover is in a closed position.

20 Claims, 5 Drawing Sheets

METHOD AND APPARATUS FOR GROUNDING A CABLE

The present invention relates generally to communication networks and, more particularly, to an apparatus for grounding cables, e.g., fiber cables or copper wire cables for safety from voltages induced from power lines and lightning.

BACKGROUND OF THE INVENTION

The communications infrastructures such as used in telecommunications networks may include buried fiber cables. These buried fiber cables require grounding for ensuring safe operation of the equipment and protection of maintenance personnel from voltages induced from lightning or power lines. Currently, buried fiber cables are grounded with manual connections to grounding rods through termination closures. For example, when a maintenance worker accesses fiber cables to perform tasks such as cable locating functions, the maintenance worker is expected to remove the grounding connector(s) manually before starting the tests. The maintenance worker then accesses the fibers, conducts the tests to locate the desired fiber cables, and places back the grounding connector into its proper position when the task is finished. However, the maintenance worker may forget to place the grounding connector back onto the fiber cable and leaves the fiber and any equipment attached to the fiber vulnerable to unintended voltages. In addition, this may create potentially a hazardous condition for maintenance personnel who may need to access the fiber lines at a future time, where the maintenance personnel are expecting the fiber cable to be grounded prior to performing various maintenance tasks.

Therefore, there is a need for a method and apparatus that enable an automatic grounding of fiber cables.

SUMMARY OF THE INVENTION

In one embodiment, the present invention discloses a method and apparatus for grounding cables (e.g., fiber cables and/or copper wire cables) used in networks such as the telecommunications networks. For example, the apparatus comprises an enclosure having a plurality of metal posts, e.g., metallic bolts, (e.g. brass or copper) for connecting with cables and at least one grounding rod. The apparatus contains apertures for allowing cables and at least one grounding rod to be brought into the apparatus in order to reach the metal posts. The grounding rod is then connected to one of the posts, and one or more of the cables are also connected to one or more of the posts. In one embodiment, the apparatus employs a movable cover with a conducting member (e.g., a metal hinged plate) mounted onto the movable cover.

In operation, the metal plate makes contact with all the posts and provides grounding to all the cables when the cover is in a closed position. When the cover is in an open position, the metal hinged plate is pulled away from all the posts, thereby removing the grounding protection simultaneously to all the cables.

BRIEF DESCRIPTION OF THE DRAWINGS

The teaching of the present invention can be readily understood by considering the following description in conjunction with the accompanying drawings, in which.

Figure 1:
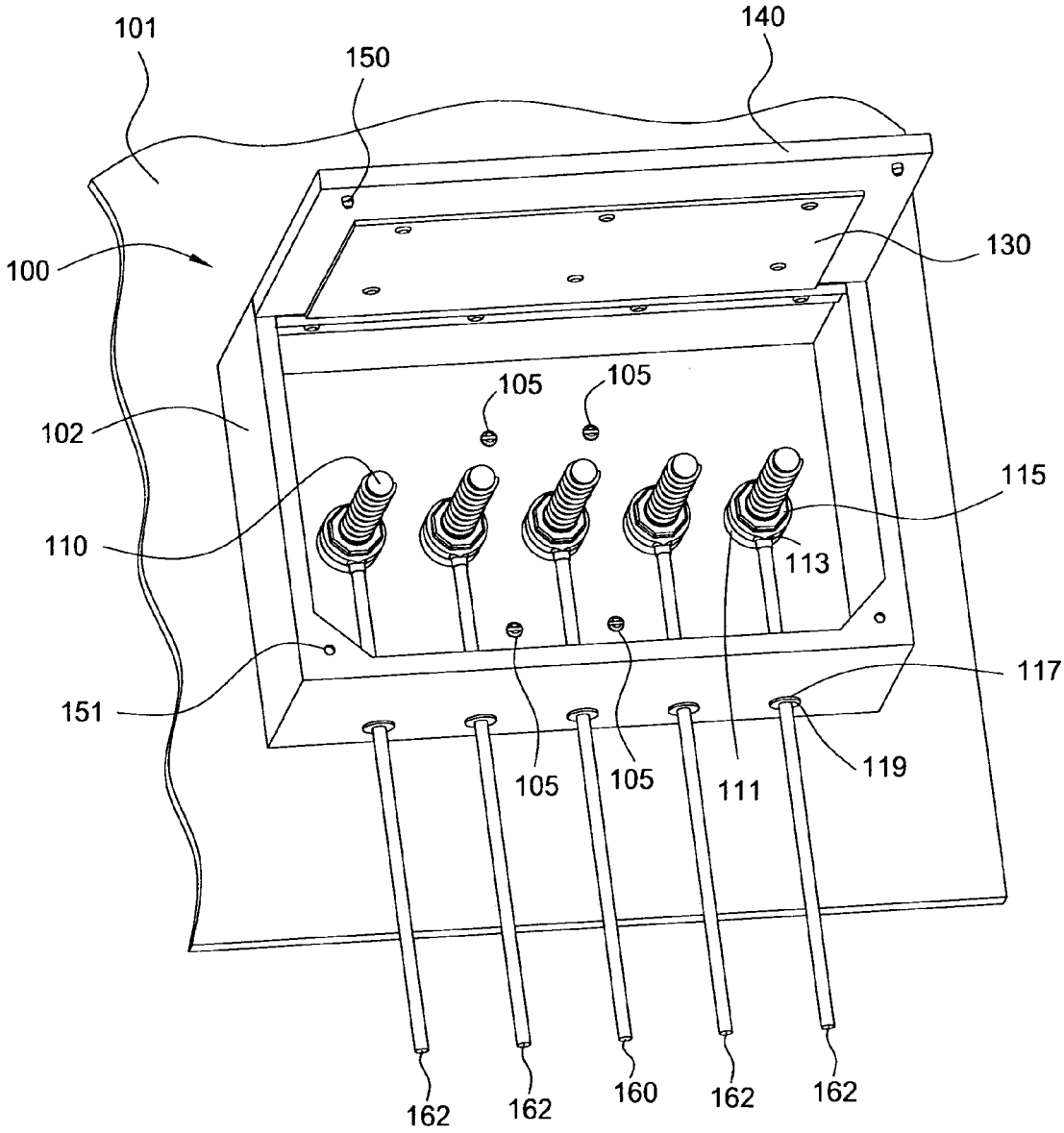
FIG. 1 provides a schematic view of an embodiment of an apparatus for grounding cables.

To facilitate understanding, identical reference numerals have been used, where possible, to designate identical elements that are common to the figures. It is to be noted, however, that the drawings illustrate only typical embodiments of this invention and are therefore not to be considered limiting its scope, for the invention may admit to other equally effective embodiments.

DETAILED DESCRIPTION

The present invention broadly discloses an apparatus for grounding cables, e.g., fiber cables and copper wire cables used in networks such as telecommunications networks. Although the present invention is described below in the context of telecommunications networks, the present invention is not so limited. Namely, the present invention can be adapted to any networks where grounding of cables would be beneficial. Although the present invention is described below in the context of fiber cables, the present invention is not so limited. Namely, the present invention can be applied to any metal wire cables, e.g., copper wire cables and the like.

To better understand the present invention, FIG. 1 provides a schematic view of one embodiment of an apparatus 100 for grounding fiber cables. In one illustrative example, the apparatus is mounted on a surface 101 (e.g., a wall, right-of-way marker pole, etc.) using fasteners, e.g., screws 105. In this illustrative embodiment, the grounding apparatus 100 comprises an enclosure 102, e.g., a rectangular shaped poly-vinyl box. It should be noted that the enclosure 102 of apparatus 100 is not limited to a rectangular shape having six sides or walls. The enclosure can be implemented in any shapes with any number of sides as required for a particular deployment.

In one embodiment, one side of the enclosure 102 is provided with a plurality of apertures for receiving a plurality of studs or posts 110, e.g., brass or copper bolts mounted on the wall of the enclosure for terminating fiber cables 162 and at least one grounding rod 160. The enclosure has a lid, a door, or broadly a cover 140, e.g., a movable plastic cover for easy access. The cover 140 may contain twist fasteners 150 as a locking mechanism. The twist fasteners 150 are used to secure the cover in a closed position by engaging twist fastener holes 151 located on the enclosure 102. It should be noted that any type of locking mechanisms for locking the apparatus 100 can be used.

In one embodiment, a conducting member, e.g., a metal hinged plate, a metal bar and/or a metal mesh 130 is attached to the cover 140. The bolts 110 are deployed in such a manner that when the cover is in the closed position, the metal hinged plate 130 makes contact with all the bolts 110. In one alternate embodiment, to ensure that all the bolts 110 are making proper contact with the conducting member 130, the bolts and/or the conducting member can be spring loaded, e.g., a post with a coil at one end or a conducting member that is implemented as a chain of spring loaded metal segments and the like. In another alternate embodiment, the bolts and/or the conducting member may comprise a set of flexible metal bristles, metal wire brush or metal mesh, thereby addressing the scenario where the bolts 110 may be set at slightly different depth within the apparatus 100.

In one embodiment, one side of the enclosure 100 is constructed to allow fiber cables and at least one grounding rod to be brought up into the enclosure via rubber grommets 117 inserted into grommet holes 119 at one side of the enclosure. For example, the grounding rod 160 is connected to the bolt 110 located in the center of the enclosure. Similarly, the metallic terminals, connectors or couplers 113 of fiber cables 162 are also connected onto the other four bolts 110, respectively. It should be noted that although only four fiber cables 162 are illustrated, any number of fiber cables can be deployed in the present invention.

When the cover 140 is in the closed position, the metallic plate 130 makes contact with all the bolts 110. Since the bolt in the center makes contact with the grounding rod 160, the grounding rod provides grounding protection for all the fiber cables 162. When the cover 140 is in the opened position, the grounding mechanism is pulled away from all the bolts. Thus, when a maintenance worker opens the apparatus 100, he or she will be confident that prior to the opening of the cover, all the fiber cables have been previously grounded.

Figure 2:
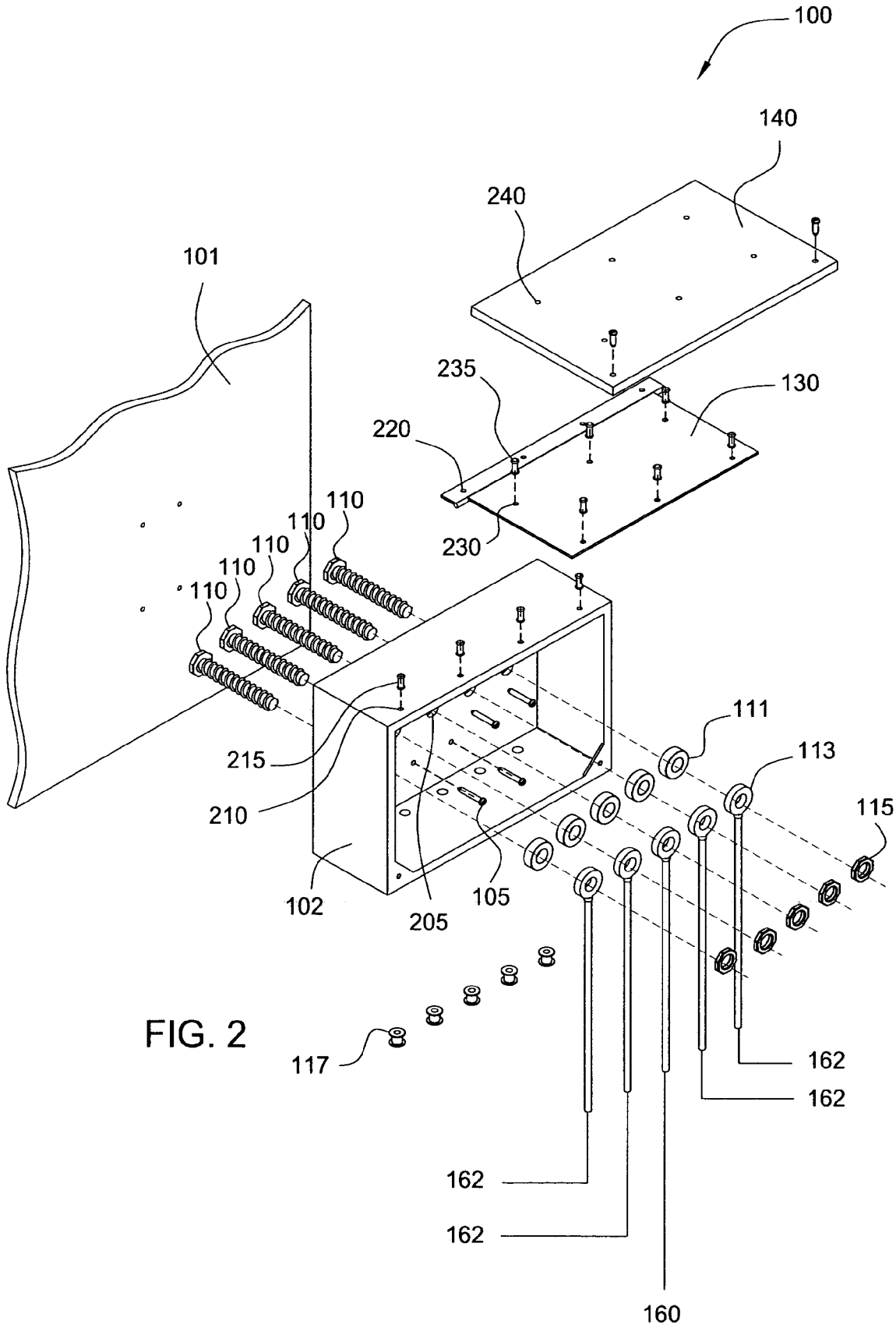
FIG. 2 provides an exploded view of the grounding apparatus.
Figure 3:
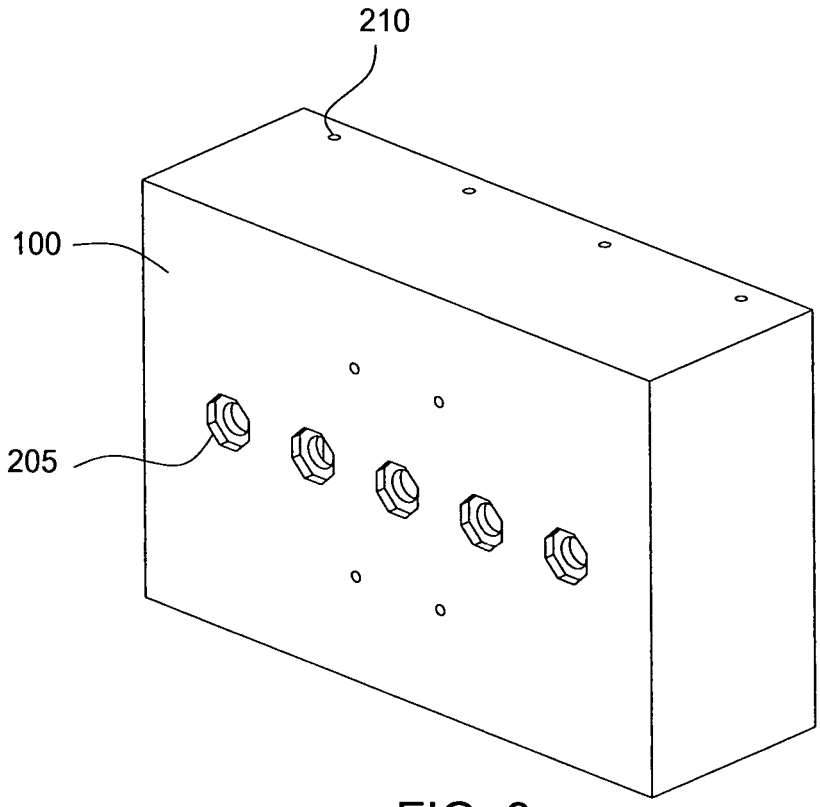
FIG. 3 provides a schematic rear view of the enclosure of the grounding apparatus.
Figure 4:
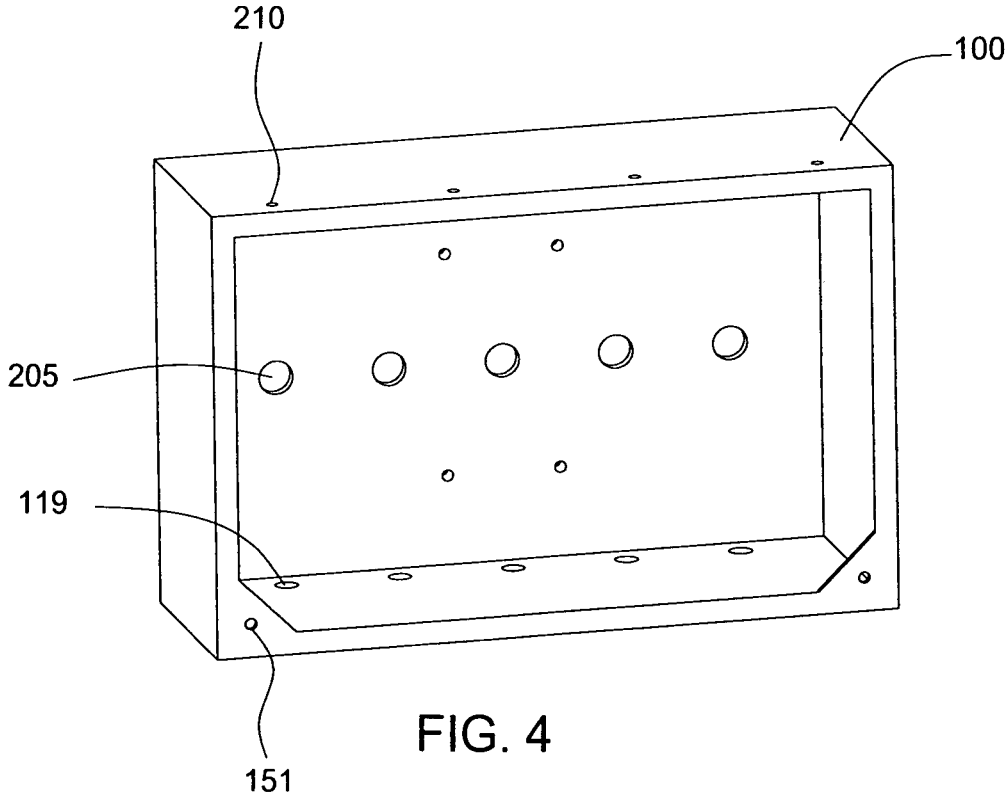
FIG. 4 provides a schematic front view of the enclosure of the grounding apparatus.
Figure 5:
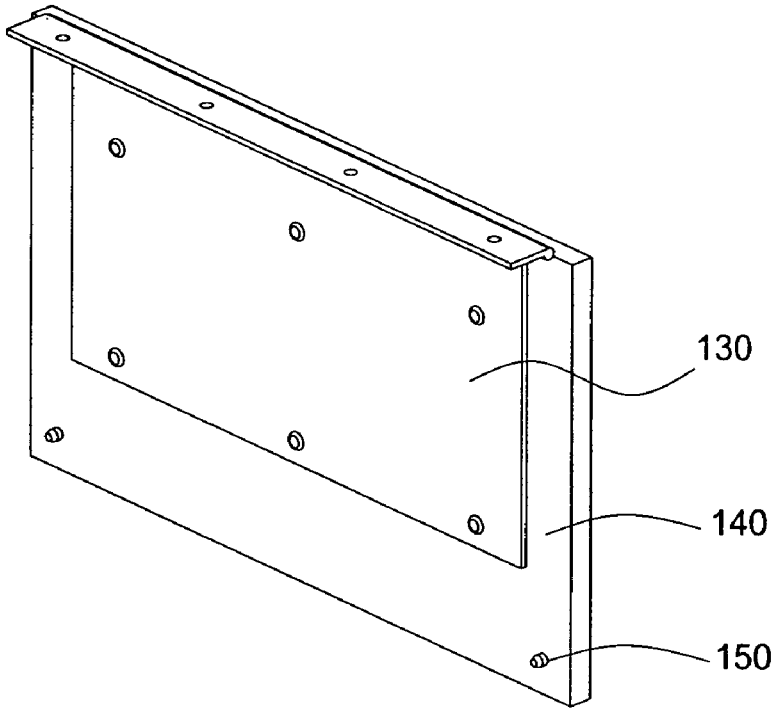
FIG. 5 provides a schematic view of a cover for the enclosure of the grounding apparatus.
Figure 6:
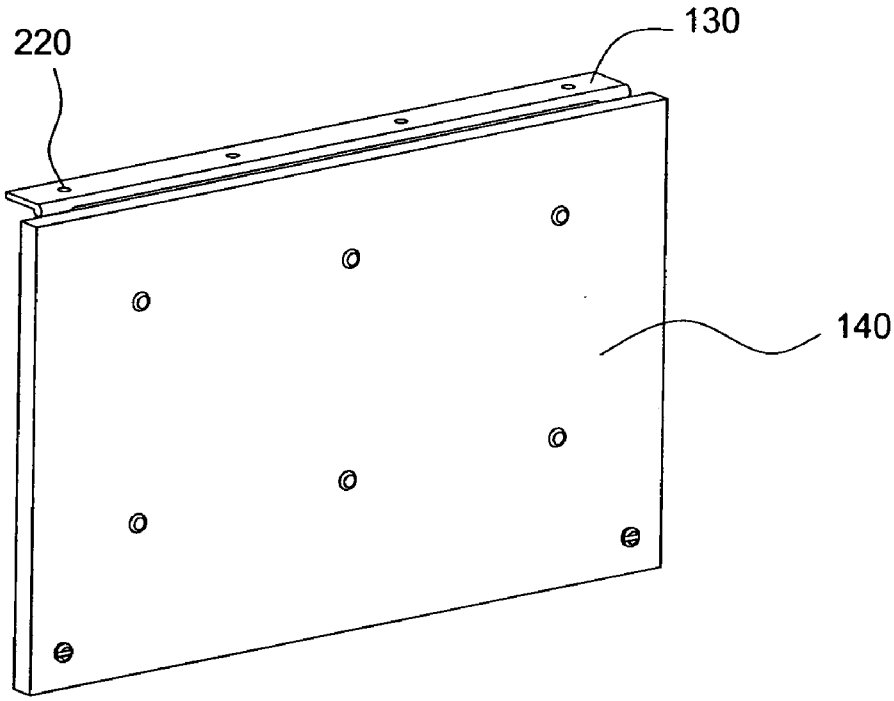
FIG. 6 provides another schematic view of the cover.

FIG. 2 provides an exploded view of the present grounding apparatus 100. The reader is encouraged to refer to FIGS. 2-6 simultaneously to better understand the description of the present invention. FIG. 3 and FIG. 4 provide a schematic rear and front view of the enclosure 100, respectively. FIG. 5 provides a schematic view of the cover 140 with the metal plate 130 attached. FIG. 6 provides another schematic view of the cover 140.

In one embodiment, the enclosure 102 contains molded slots 205 (also shown in FIG. 3) for receiving the bolts 110. The bolts 110 are inserted through the molded slots and secured when the enclosure is attached to the surface 101. Since the molded slots 205 are shaped similarly to the head of the bolts 110, the molded slots will assist in restraining the bolts from spinning when the fiber cables 162 are being mounted onto the bolts 110.

In one embodiment, the metallic connectors or couplers 113 of the fiber cables 162 and the grounding rod 160 are secured to the bolts 110 using washers 111 and nuts 115. In one embodiment, rivets 215 are used to attach the hinge plate 130 to the enclosure 100. The rivet holes 210 and 220 for the enclosure and the hinge plate 130 are shown in FIG. 2, respectively. The hinge plate 130 is attached to the cover or lid 140 using rivets 235. The metal hinge plate 130 comprises a plurality of rivet holes 230 for receiving the rivets 235. Similarly, the cover or lid 140 comprises a plurality of rivet holes 240 for receiving the rivets 235 as well. It should be noted that in one embodiment the hinge plate is spring loaded such that in the closed position, a pressure is applied to the hinge plate to ensure proper contact with the metal bolts 110.

Figure 7:
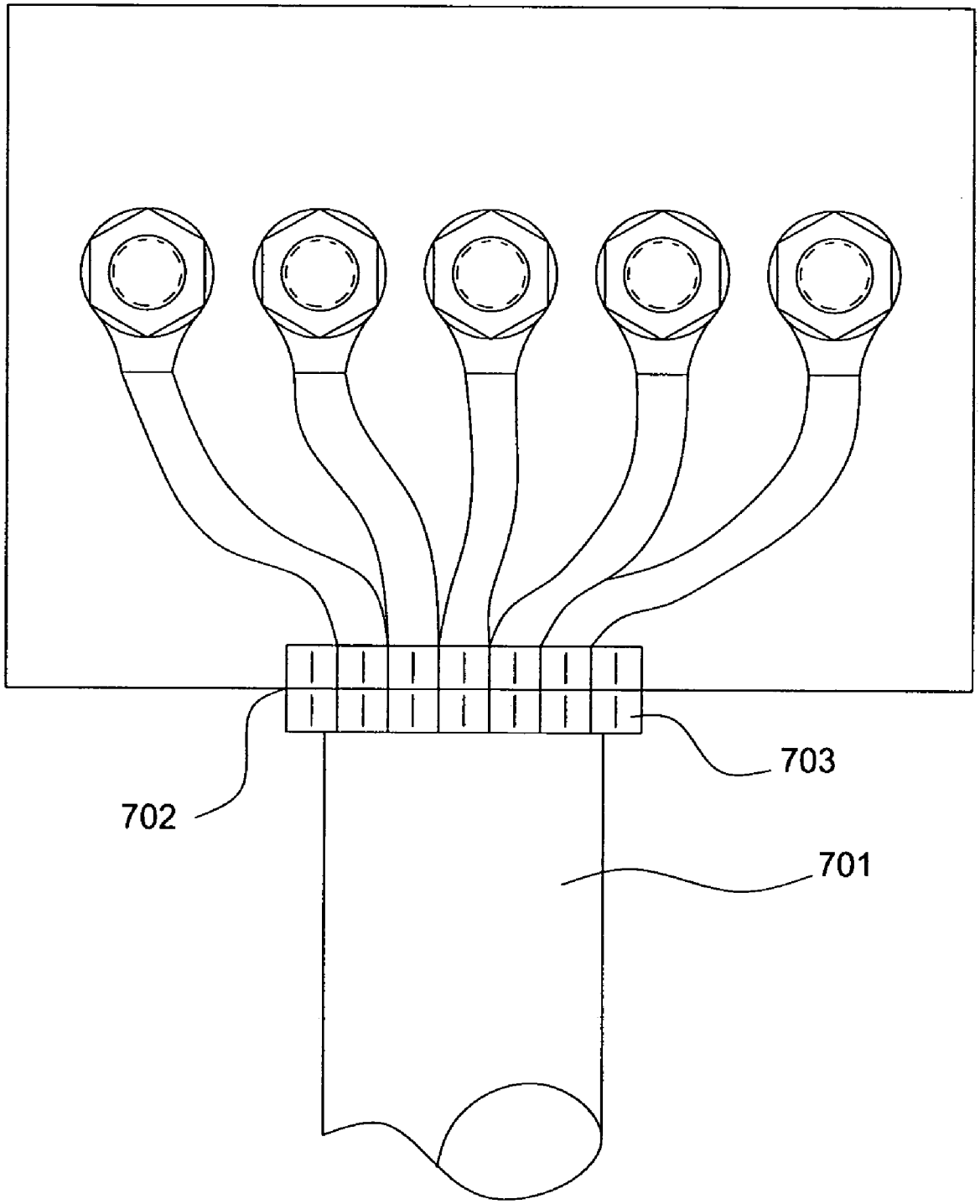
FIG. 7 illustrates an embodiment of the apparatus for grounding cables that enables the cables and grounding rod to be routed through a pipe.

FIG. 7 illustrates an embodiment of the apparatus for grounding fiber cables that enables the fiber cables and at least one grounding rod to be routed through a pipe 701. In this embodiment, one side of the enclosure 100 comprises an aperture or hole 702 that is sized for receiving the pipe 701. Since the aperture 702 is sized to accommodate multiple cables, the aperture 702 will be larger than the apertures 119 that are used to receive individual cables. In one embodiment, if the pipe 701 is implemented using PVC pipes, then appropriate PVC interconnection devices 703 are used to connect the pipe 701 to the apparatus 100.

The present apparatus 100 for grounding fiber cables can be used at test and ground stations. The apparatus 100 may be mounted on a fiber cable marker pole, etc. The five brass or copper metallic bolts are then used as terminal posts inside the test and grounding station. In one example, the center terminal post 110 is used to connect a number-6 gauge wire between the terminal and the buried grounding rod. The other four (4) terminal posts may then be used to connect between the test station and the fiber cable into which the locating signal is to be injected. In another example, a test technician may use the other four terminal posts to measure the fiber cables sheath resistance when fault locating the cable sheath and the like.

In one embodiment, the dimensions of the apparatus may be varied to accommodate various types and sizes of test and grounding stations. In another embodiment, the apparatus may be designed to accommodate various climate conditions. For example, the apparatus may be splash proof, suitable for extreme weather conditions, etc.

In one embodiment, the apparatus of the current invention may be implemented using other metallic devices instead of bolts 110 for providing grounding for all the fibers via the metallic plate attached to the cover. Namely, as discussed above, spring loaded mechanisms can be deployed on the bolts and/or on the metal plate. Furthermore, metal bristles, metal wire brush, and/or metal mesh can also be deployed on the bolts and/or on the metal plate.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. An apparatus for grounding cables, comprising:

an enclosure;

a plurality of posts coupled to said enclosure, wherein a first post of said plurality of posts is for coupling with at least one cable, and wherein a second post of said plurality of posts is for coupling with at least one grounding rod; and a movable cover coupled to said enclosure, where said movable cover comprises a conducting member, wherein when said movable cover is set at a closed position, said conducting member contacts both of said first post and said second post simultaneously.

2. The apparatus of claim 1, wherein said movable cover is a spring loaded movable cover.

3. The apparatus of claim 1, wherein said conducting member comprises at least one of: a metal plate, a metal bar, a set of flexible metal bristles, a metal wire brush, or a metal mesh.

4. The apparatus of claim 1, wherein said at least one cable comprises at least one fiber optic cable or at least one metal wire cable.

5. The apparatus of claim 1, wherein said plurality of posts comprises a plurality of spring loaded posts.

6. The apparatus of claim 1, wherein each of said plurality of posts comprises at least one of: a set of flexible metal bristles, a metal wire brush, or a metal mesh.

7. The apparatus of claim 1, wherein when said movable cover is set at an open position, contact between said conducting member and both of said first post and said second post is removed simultaneously.

8. The apparatus of claim 1, wherein said enclosure comprises a poly-vinyl box.

9. The apparatus of claim 1, wherein said conducting member is a metal hinged plate attached to said movable cover.

10. The apparatus of claim 1, further comprising:

at least one fastener for locking said movable cover to said enclosure when said movable cover is set at said closed position.

11. An apparatus for grounding cables, comprising:

means for enclosing;

means for providing a plurality of posts coupled to said enclosing means, wherein a first post of said plurality of posts is for coupling with at least one cable, and wherein a second post of said plurality of posts is for coupling with at least one grounding rod; and means for movably covering said enclosing means, where said covering means comprises a conducting member, wherein when said covering means is set at a closed position, said conducting member contacts both of said first post and said second post simultaneously.

12. The apparatus of claim 11, wherein said covering means comprises a spring loaded movable cover.

13. The apparatus of claim 11, wherein said conducting member comprises at least one of: a metal plate, a metal bar, a set of flexible metal bristles, a metal wire brush, or a metal mesh.

14. The apparatus of claim 11, wherein said at least one cable comprises at least one fiber optic cable or at least one metal wire cable.

15. The apparatus of claim 11, wherein said plurality of posts comprises a plurality of spring loaded posts.

16. The apparatus of claim 11, wherein each of said plurality of posts comprises at least one of: a set of flexible metal bristles, a metal wire brush, or a metal mesh.

17. The apparatus of claim 11, wherein when said covering means is set at an open position, contact between said conducting member and both of said first post and said second post is removed simultaneously.

18. The apparatus of claim 11, wherein said enclosing means comprises a poly-vinyl box.

19. The apparatus of claim 11, wherein said conducting member is a metal hinged plate attached to said covering means.

20. A method for grounding cables, comprising:

providing an enclosure;

providing a plurality of posts coupled to said enclosure, wherein a first post of said plurality of posts is for coupling with at least one cable, and wherein a second post of said plurality of posts is for coupling with at least one grounding rod; and providing a movable cover coupled to said enclosure, where said movable cover comprises a conducting member, wherein when said movable cover is set at a closed position, said conducting member contacts both of said first post and said second post simultaneously.

* * * * *